US008157402B2

(12) United States Patent
Huss et al.

(10) Patent No.: US 8,157,402 B2
(45) Date of Patent: Apr. 17, 2012

(54) ILLUMINATED HELMET WITH PROGRAMMABLE LAMPS AND PROXIMITY SENSOR

(75) Inventors: Stephen James Huss, San Diego, CA (US); Bryan Joseph Nielsen, San Diego, CA (US)

(73) Assignee: Barseventy, Inc., San Diego, CA (US)

( * ) Notice: Subject to any disclaimer, the term of this patent is extended or adjusted under 35 U.S.C. 154(b) by 0 days.

(21) Appl. No.: 12/300,327

(22) PCT Filed: May 8, 2007

(86) PCT No.: PCT/US2007/068464

§ 371 (c)(1),
(2), (4) Date: Nov. 10, 2008

(87) PCT Pub. No.: WO2007/134047

PCT Pub. Date: Nov. 22, 2007

(65) Prior Publication Data

US 2009/0303698 A1 Dec. 10, 2009

Related U.S. Application Data

(60) Provisional application No. 60/746,721, filed on May 8, 2006.

(51) Int. Cl.
*F21V 21/084* (2006.01)

(52) U.S. Cl. ..... 362/106; 362/103; 362/105; 362/802

(58) Field of Classification Search ..... 362/103, 362/105, 106, 802
See application file for complete search history.

(56) References Cited

U.S. PATENT DOCUMENTS

| | | | | |
|---|---|---|---|---|
| 5,416,675 | A | 5/1995 | DeBeaux | |
| 5,479,325 | A * | 12/1995 | Chien | 362/105 |
| 5,680,718 | A * | 10/1997 | Ratcliffe et al. | 40/329 |
| 5,743,621 | A | 4/1998 | Mantha et al. | |
| 5,758,947 | A * | 6/1998 | Glatt | 362/105 |
| 5,871,271 | A * | 2/1999 | Chien | 362/106 |
| 5,931,559 | A * | 8/1999 | Pfaeffle | 362/106 |
| 6,007,213 | A * | 12/1999 | Baumgartner | 362/106 |
| 6,157,298 | A | 12/2000 | Garfinkel et al. | |
| 6,244,721 | B1 * | 6/2001 | Rodriguez et al. | 362/106 |
| 6,325,521 | B1 * | 12/2001 | Gregg et al. | 362/106 |
| 6,634,031 | B1 * | 10/2003 | Schlapkohl | 2/209.13 |
| 7,128,434 | B1 * | 10/2006 | Nally et al. | 362/105 |
| 2005/0219837 | A1 * | 10/2005 | Brown | 362/105 |

FOREIGN PATENT DOCUMENTS

GB 2169711 A * 7/1986

* cited by examiner

*Primary Examiner* — Ismael Negron
(74) *Attorney, Agent, or Firm* — Sughrue Mion, PLLC

(57) ABSTRACT

An illuminated helmet with a plurality of lamps positioned in at least one recess, a controller to operate the lamps in a flashing pattern, and a proximity sensor to activate the controller and lamps upon detection of a user's head. The recesses for the lamps and other components are located in a non-impact area of the helmet. The lamps are arranged to be visible to a viewer from any angle, and the flashing patterns of the lamps are programmed to draw the attention of the human eye.

17 Claims, 13 Drawing Sheets

ILLUMINATED HELMET WITH PROGRAMMABLE LAMPS AND PROXIMITY SENSOR

PRIORITY CLAIM

This application claims the benefit of priority to U.S. Provisional Application No. 60/746,721, filed May 8, 2006, entitled "Illuminated Helmet."

FIELD OF THE INVENTION

The present invention relates to a protective helmet incorporating an illumination system, and more specifically a sensor-activated illumination system.

BACKGROUND OF THE INVENTION

Protective helmets are worn for protecting a wearer's head in performing many different activities. Activities may include construction work, bicycling, riding a motorcycle or participating in athletic activities. In addition to protecting a wearer's head from damaging impact, a helmet may serve the safety function, increasing the wearers visibility under all conditions; day or night, rain or fog. Reflectors have been used as a low-cost visibility aid. However, reflectors are passive devices. Their efficacy is affected by the nature of the illumination source, the angle of incidence and the position of a viewer and have little to no effect during the day. Helmets have been provided with active illumination sources such as bulbs, or more recently light emitting diodes ("LEDs").

One prior art illuminated helmet is disclosed in U.S. Pat. No. 5,743,621. A helmet includes first and second LED modules that are mounted at the front and at the back of a helmet respectively. The helmet has a chin strap fitted with snap together connectors which operate as a switch to turn the assembly on when joined to secure the helmet to a user's head. The wiring used to control the on/off state of the LED modules must extend outside of the helmet into the chin strap. Wiring cannot be contained within a module inside the helmet, and is subject to mechanical stresses associated with using the chinstrap and holding the helmet to the user's head. The LED modules are on or off. They are not capable of providing additional intelligence and are prone to failure.

U.S. Pat. No. 5,416,675 discloses a moving illuminated display for a helmet, disposed upon the rear thereof. The display is mounted on a module which adheres to the exterior of the helmet, as by a hook and loop (e.g., Velcro) fastener. The illuminated display is provided by a series or matrix of light emitting diodes mounted to the module. Controlling electronic circuitry, a battery cell, and one of two actuating switches are also located on the module. One actuating switch, located within the helmet and connected to the module by a cable, is a contact responsive switch which is tripped when the user dons the helmet. The other switch, mounted to the module, is a light sensor, which is exposed to ambient light and is responsive to fading daylight. The module is attached to an otherwise conventional helmet. The module is not integrated with the helmet design, and only emits light from the location at which the module is attached and not from an entire periphery of the helmet. A contact switch is placed inside the helmet to be tripped by the user's head. The contact wiring must extend from the switch to the module. A flat wiring cable is consequently exposed on the inside of the helmet and the outside of the helmet, and is not protected by helmet structure. In addition, it is questionable from a safety stand point to place a foreign object directly against the head within the helmet.

U.S. Pat. No. 5,871,271 discloses protective headwear having at least a hard-shell outer layer and a protective shock-absorbing layer. At least one LED illumination arrangement is fitted into recesses in the protective layer and visible through an at least partially transparent area of the hardtop shell in any desired pattern or combination of lighting elements. A control circuit, in the form of a multiple function integrated circuit controller, controls the on/off times and sequences for individual LEDs which are switchable so as to achieve any desired combination of special effects. The special effects include timing the illumination of discrete LEDs. However, an illuminated matrix capable of providing selectable information or patterns is not disclosed. The on/off switch is housed in a cavity at an upper surface at the front of the helmet. A user must focus attention on the structure housing the on/off switch in order to operate it. The on/off switch cannot be operated with a minimal amount of attention. In addition, the described lens will actually decrease the intensity (density) of the light by spreading the same amount of light across a larger area. The mass presented described lens also decreases the safety by creating a large mass which can be driven through the protective foam upon direct impact.

U.S. Pat. No. 6,157,298 discloses a helmet having directional signals, a brake light and other circuitry, AM/FM radio, and two-way communication capabilities. The illumination circuitry does not include means for producing flashing patterns of LED signals to enhance visibility of a user.

U.S. Pat. No. 5,758,947 discloses an illuminated safety helmet including a protective core and a substrate, which may be an impact resistant shell, disposed on the protective core. A plurality of light emitting diodes and traces for electrically connecting the light emitting diodes are disposed on the substrate. While the LEDs are included in a modular unit including control circuitry, discrete LEDs are provided rather than LEDs cooperating in a matrix.

Prior art illuminated helmets, particularly bicycle helmets, are constructed as consumer apparatus rather than as professional instrumentation. The illumination system battery power supplies do not include power conditioning circuitry. Weatherproofing is not a design requirement. However, the above-cited '271 patent, for example, suggests that such helmets may be worn by policemen. Police require high reliability, high performance equipment. In foreseeable scenarios, their lives may depend on the reliability of their equipment. However, the prior art has not recognized the need for high reliability in illuminated helmets.

Prior art designs generally require a helmet design based on inclusion of a control system. The designs are not adapted to fit into preexisting helmet designs. The placement of and shape of solid sections and apertures in many helmet designs is selected to provide specific performance characteristics in terms of absorbing impact, transmitting force from one part of a helmet to another, lessening total weight and providing ventilation. The helmet design may also comprise a distinctive style of commercial significance. Prior art systems have not been provided with integrated illumination systems into existing helmets without compromising their function or style.

Additionally, what is needed is a helmet with an automated sensor that lacks mechanical parts so as to reduce the risk of injury to a user in an accident and eliminate the need to manually turn the lights on before use. Further, an improved layout and illumination pattern of the lights is needed to protect the lamps from damage, increase the visibility of the helmet, and protect the user from injury from the lamps in an accident.

SUMMARY OF THE INVENTION

The present invention solves the aforementioned problems and provides for the aforementioned needs by providing an illuminated helmet with a plurality of lamps positioned in at least one recess in the helmet to reduce the risk of damage to the lamps and prevent the lamps from injuring a user during an accident. It is also build with surface mount technology ("SMT") to minimize the thickness and reducing the overall mass; the two factors necessary to maximize safety by reducing the likelihood of the components being driven through the protective foam and into the head. The illuminated helmet also provides specific recesses for the lamps and other components located in a non-impact area of the helmet to further reduce the risk of injury from the components and lamps in an accident. Furthermore, the illuminated helmet provides a proximity sensor mounted within the helmet that lacks mechanical parts and automatically activates the lamps when the helmet is worn by a user, improving the safety and reliability of the proximity sensor and the overall helmet. The lamps are arranged in such a manner as to be visible to a viewer from any angle, and the flashing patterns of the lamps are uniquely programmed to draw the attention of the human eye.

In one embodiment of the present invention, an illuminated helmet comprises a helmet structure with an outer shell and an inner core, wherein the helmet structure is further divided into an impact area and a non-impact area; at least one recess in the helmet structure; a plurality of lamps positioned in the recess of the helmet structure; a controller connected with the plurality of lamps to operate the lamps; a proximity sensor connected with the controller to activate the controller and lamps upon detection of a proximity; and a power source connected with the controller to provide power to the controller, sensor and lamps.

In a further embodiment, the outer shell is a thin layer of plastic, and wherein the inner core is compressible, impact-absorbing foam.

In a further embodiment, the recess in the helmet structure is an aperture between the outer shell and the inner core.

In a further embodiment, the lamps are light-emitting diodes ("LEDs").

In a further embodiment, the LEDs are arranged in groups within the recesses such that the groups of LEDs project light from the helmet in substantially all directions.

In a further embodiment, the groups of LEDs are mounted upon a flexible base.

In a further embodiment, a transparent protecting layer covers the lamps.

In a further embodiment, the transparent protecting layer is clear plastic.

In a further embodiment, the lamps are positioned on the non-impact area of the helmet.

In a further embodiment, the controller is printed on a flexible circuit board.

In a further embodiment, the controller is a complex programmable logic device.

In a further embodiment, the proximity sensor is an electrode that can be positioned on the outside of the protective foam and detect a change in capacitance when a user puts on or removes the helmet, and wherein the proximity sensor sends an appropriate output signal to the controller when the change in capacitance is detected.

In a further embodiment, the power source is a battery.

In a further embodiment, the controller and power source are mounted upon the non-impact area of the helmet structure.

DETAILED DESCRIPTION OF THE INVENTION

The object of the present invention is to provide an illuminated helmet with improved design, visibility and safety. The present invention provides an illuminated helmet with a plurality of lamps positioned in at least one recess in the helmet to reduce the risk of damage to the lamps and prevent the lamps from injuring a user during an accident. It is also build with surface mount technology ("SMT") to minimize the thickness and reducing the overall mass; the two factors necessary to maximize safety by reducing the likelihood of the components being driven through the protective foam and into the head. The illuminated helmet also provides specific recesses for the lamps and other components located in a non-impact area of the helmet to further reduce the risk of injury from the components and lamps in an accident. Furthermore, the illuminated helmet provides a proximity sensor mounted within the helmet that lacks mechanical parts and automatically activates the lamps when the helmet is worn by a user, improving the safety and reliability of the proximity sensor and overall helmet. The lamps are arranged in such a manner as to be visible to a viewer from any angle, and the flashing patterns of the lamps are uniquely programmed to draw the attention of the human eye.

Figure 1:
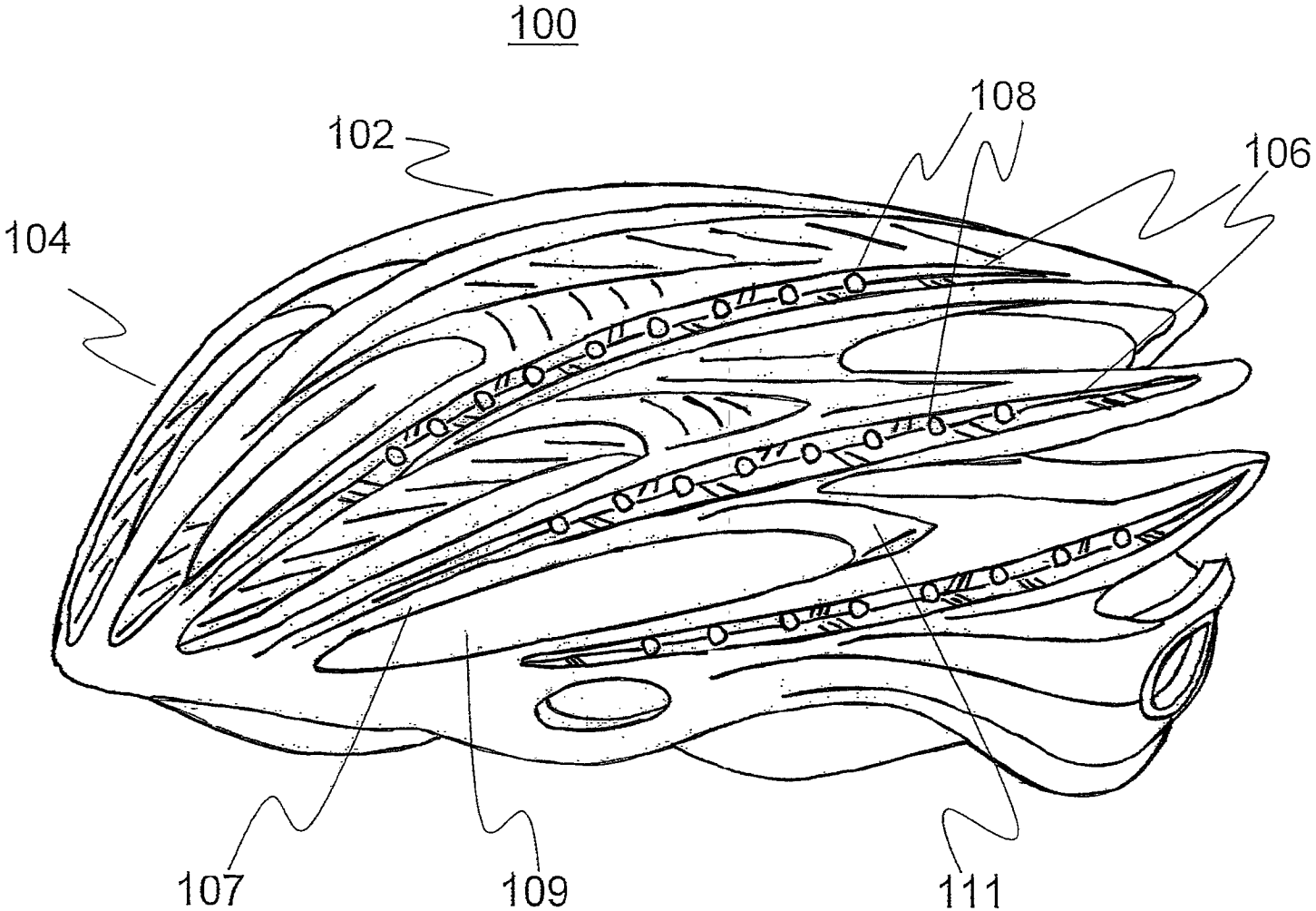
FIG. 1 is a front left side perspective view of an illuminated helmet according to one aspect of the present invention, depicting a plurality of lamps positioned within recesses in a helmet structure.

In one aspect of the invention, as illustrated in FIG. 1, an illuminated helmet 100 is provided with a helmet structure 102 including an outer shell 104. The helmet structure 102 is further defined by several recesses 106 formed into the outer shell 104 and protruding into the inner core 105 (see FIG. 2). Within the recesses 106 are a plurality of lamps 108 positioned at various angles to project in a multitude of directions, so as to be visible to a viewer from any angle. The lamps 108 can be light-emitting diodes ("LEDs"), and are specifically positioned with a particular density and angle that will provide a certain intensity of light to a viewer regardless of where the viewer is positioned relative to the helmet 100.

The structure of the outer shell 104 may be resolved into a plurality of ribs 107 and apertures 109. The design of the rib and aperture pattern may be both functional and ornamental. Ribs 107 are designed to bear the brunt of expected impacts. Apertures 109 may provide ventilation. The helmet 100 may also be aerodynamically shaped. Additionally, various manufacturers have developed distinctive shapes and rib patterns for their helmets. In the embodiment of FIG. 1, the recesses 106 are formed into the ribs 107, and the plurality of lamps 108 makes use of the pattern of recesses 106 for integrating the lamps 108 into the helmet 100. However, in another embodiment, the lamps are mounted into side walls 111 of the apertures 109.

Figure 2:
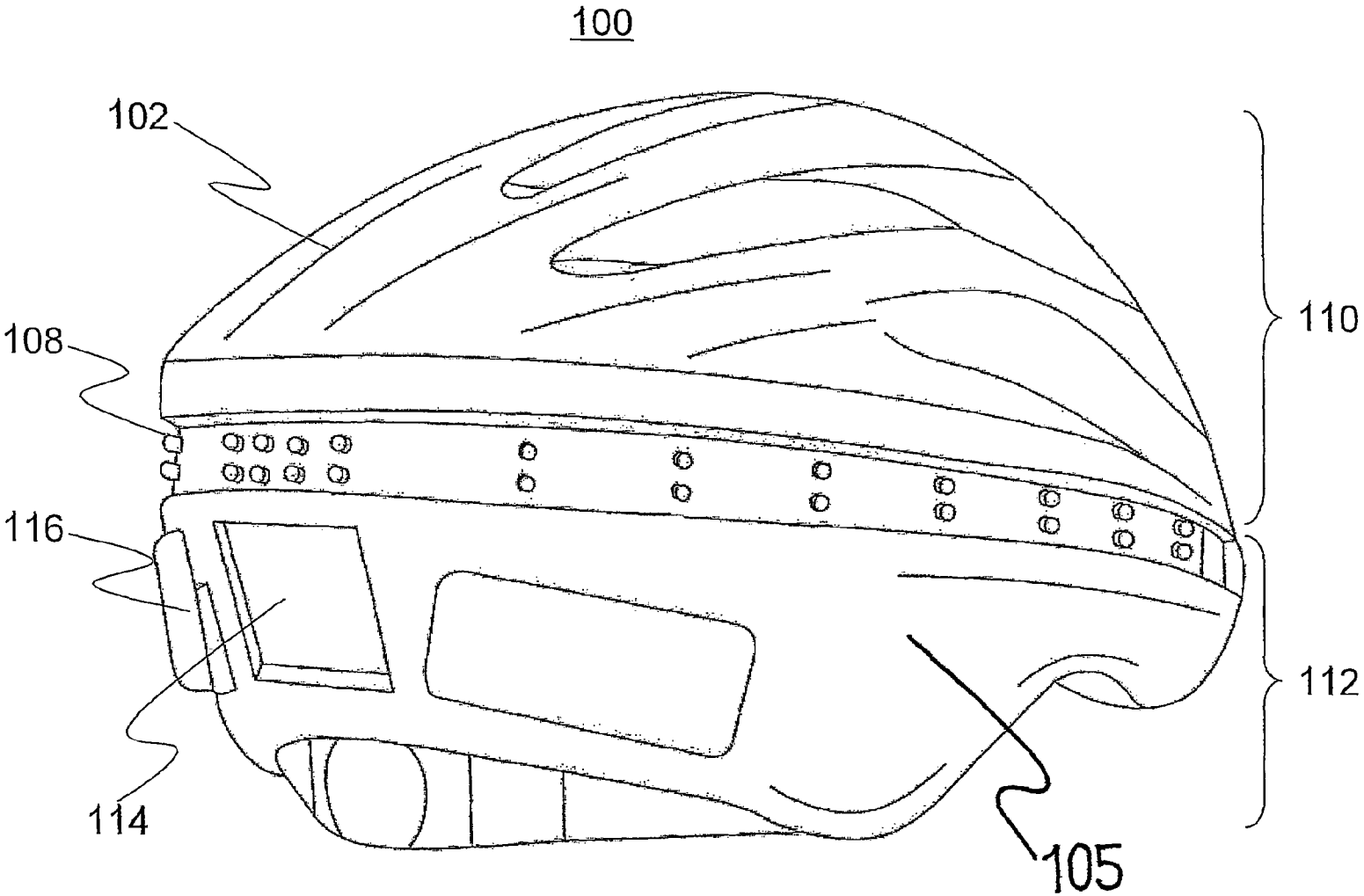
FIG. 2 is a rear right side perspective view of an illuminated helmet according to a further aspect of the present invention, depicting a plurality of lights and components mounted upon a non-impact area of the helmet structure.

In a further aspect of the present invention, as illustrated in FIG. 2, the helmet structure 102 is divided into an impact area 110 and a non-impact area 112. The non-impact area 112 falls below what is commonly known as the "test line," such that impact tests done to determine the safety of a helmet are conducted on the impact area 110 of the helmet, where an impact to a user's head in an accident is most likely to occur. In the present aspect, the plurality of lamps 108 are located in the non-impact area 112, so as reduce any risk of the lamps being impacted into the helmet structure 102 and causing injury to a user's head in an accident. Furthermore, the additional components of the illuminated helmet, such as a controller 114 and a power source 116, are also located in the non-impact area 112, with the similar rationale of reducing the risk of these larger components impacting into the helmet structure 102 during an accident and causing injury to a user's head.

Figure 3:
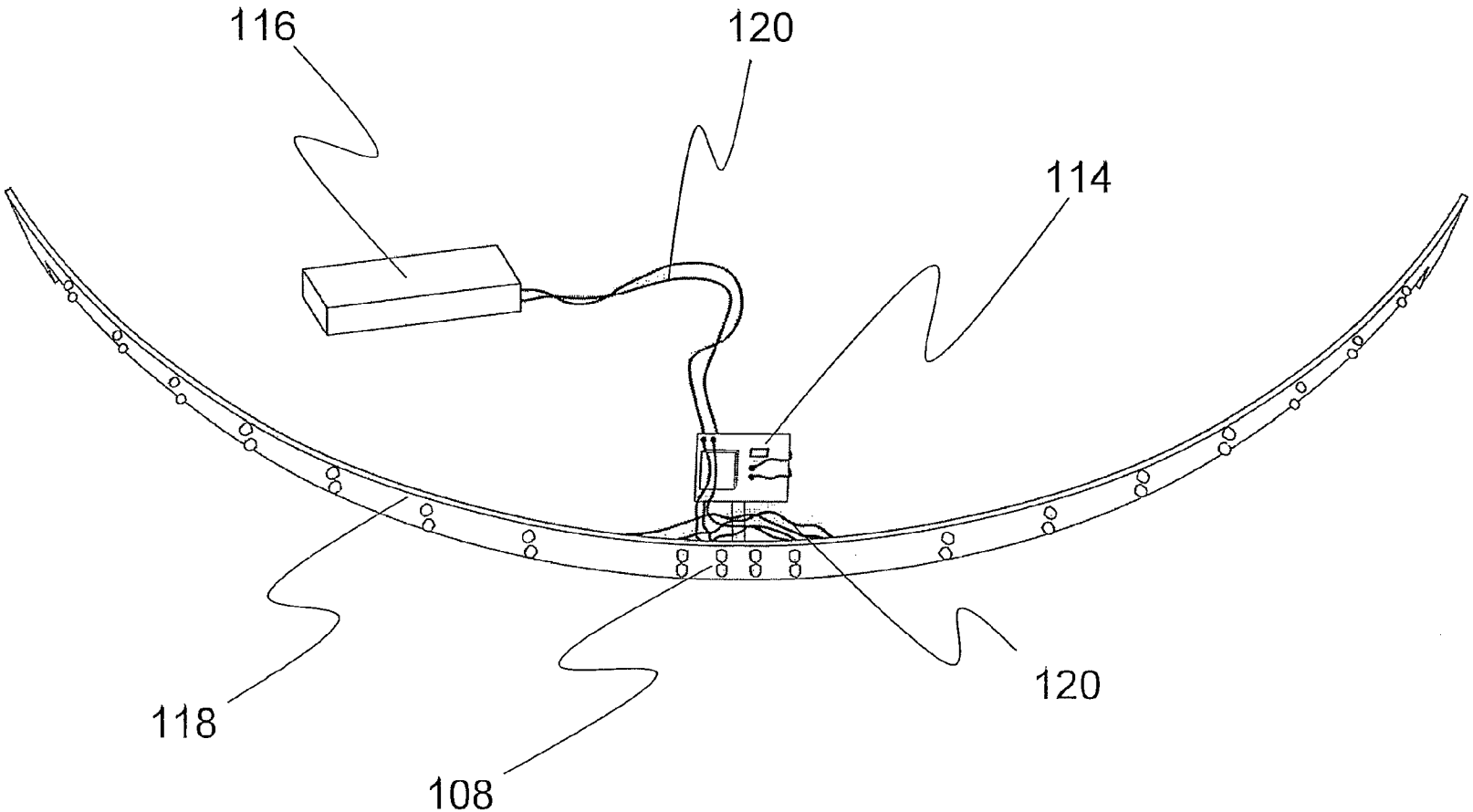
FIG. 3 is an illustration of a group of light-emitting diode ("LED") lamps mounted on a flexible base for implementing into a recess of the illuminated helmet.

In one embodiment of the invention, the lamps 108 are mounted upon a flexible base 118, as illustrated in FIG. 3. The flexible base can be a printed circuit board ("PCB") or other thin, flexible material capable of connecting the lamps along the length of the base 118. The controller 114 is connected to the flexible base 118 and the lamps 108 by wires 120, but could be implemented into the PCB if needed. The power source 116 also connects with the controller 114 using wires 120, which allows the power source 116 to be mounted in another location of the helmet structure 102, preferably the non-impact area 112, as shown in FIG. 2. In one embodiment, the lamps can also be covered by a transparent protecting layer (not shown), such as a clear plastic casing, to protect the lamps from damage or moisture.

Figure 4:
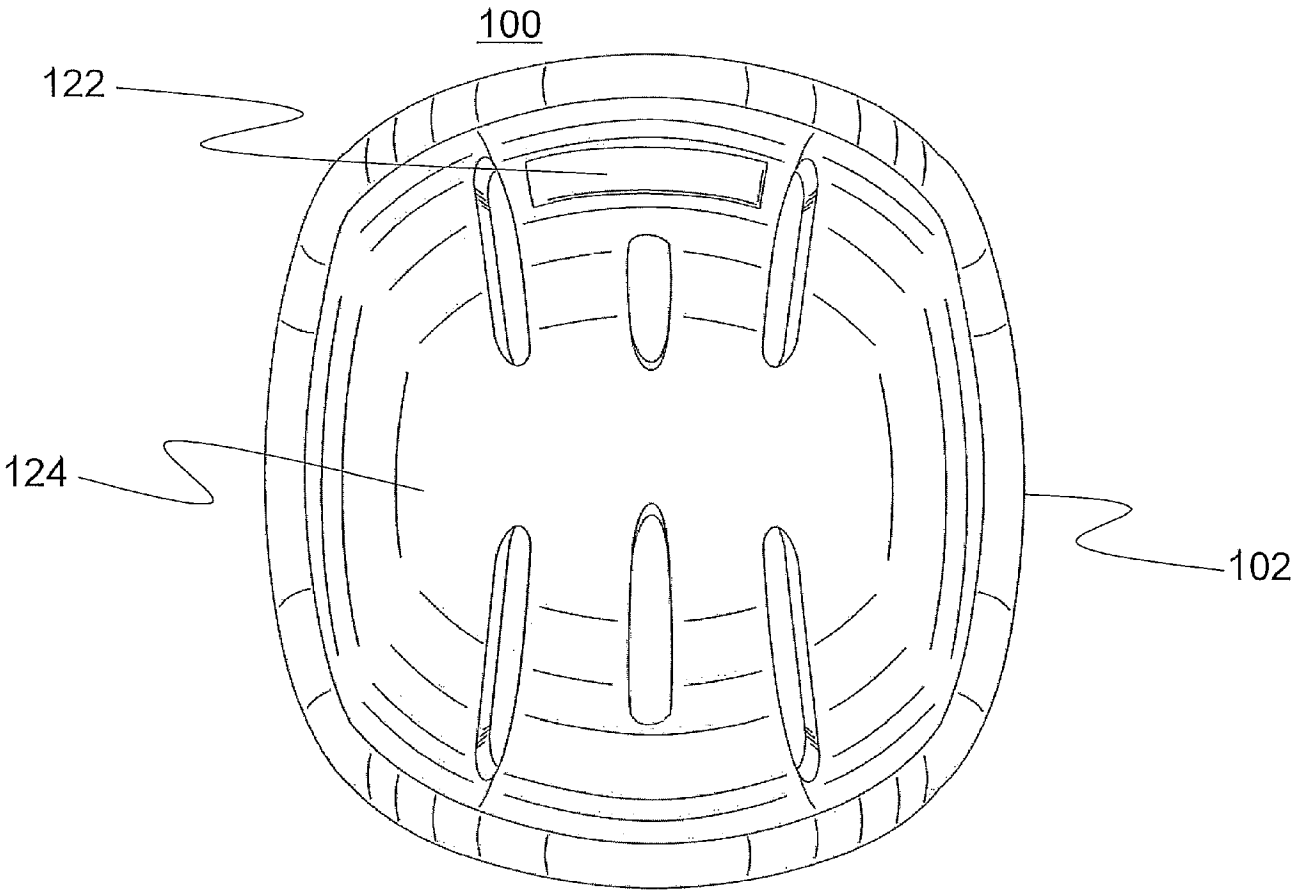
FIG. 4 is a bottom view of the illuminated helmet according to one aspect of the present invention, depicting a proximity sensor and a plurality of recesses formed in the helmet structure.

FIG. 4 illustrates an interior of the illuminated helmet 100 designed to fit a user's head, and depicts the placement of a proximity sensor 122 within the interior of the helmet structure 102. The proximity sensor is capable of detecting when a user puts on the helmet 100, so that the lamps 108 can be illuminated whenever the helmet 100 is being worn. Although visible in this illustration, the proximity sensor 122 can be buried within the inner core 124 of the helmet structure so that the sensor 122 and wires (not pictured) leading from the sensor 122 to the controller 114 (not pictured) are unseen. Burying the sensor 122 within the inner core 124 is accomplished with the use of an electrode sensor that is designed to sense a slight change in electrical capacitance that results when a user puts the helmet on his head. One example of a sensor of this type is the QTouch™ QT110 or QT111 electrode from Quantum Research Group (Pittsburgh, Pa.). No direct contact is needed between the sensor and the user, as the natural electrical field surrounding the human body is what triggers the sensor.

Interconnections between the components of the illuminated helmet are provided by various cables. The sensor 122 is actually a thin copper ribbon, which provides a safe option for implementing the sensor into the helmet, as it poses almost no risk of impacting into the user's head during an accident. A ground plane (not shown) is provided to complete a field circuit for the sensor 122. The ground plane may comprise copper electrodes spaced from the sensor 122. Most conveniently, the ground plane will be located on an inner surface of the inner core 124.

In an additional embodiment, a second sensor 123 (see FIG. 9) can be implemented to provide a discrete on and off switch for the user to manually turn the entire illumination system on or off. The manual switch is particularly advantageous if a user is not planning to wear the helmet and wants to prevent the sensor 122 in the inner core 124 from activating the lamps 108. The discrete on and off switch is discussed in further detail below with regard to the circuit diagram.

The inner core 124 is a shock-absorbing layer. The outer shell 104 is a hard, protective layer. The inner core may be made of slow recovery viscoelastic polymeric foam which allows the material to deform under impact, dissipating a large amount of energy, and return slowly to the original shape with its substantially original mechanical properties. The outer shell 104 may be made of a reinforced thermoset resin, the resin preferably being vinylester, polyester, epoxy, or other known thermoset resin. The thermoset resin may be reinforced with reinforcing fiber, e.g., glass fiber or Kevlar.

Figure 5:
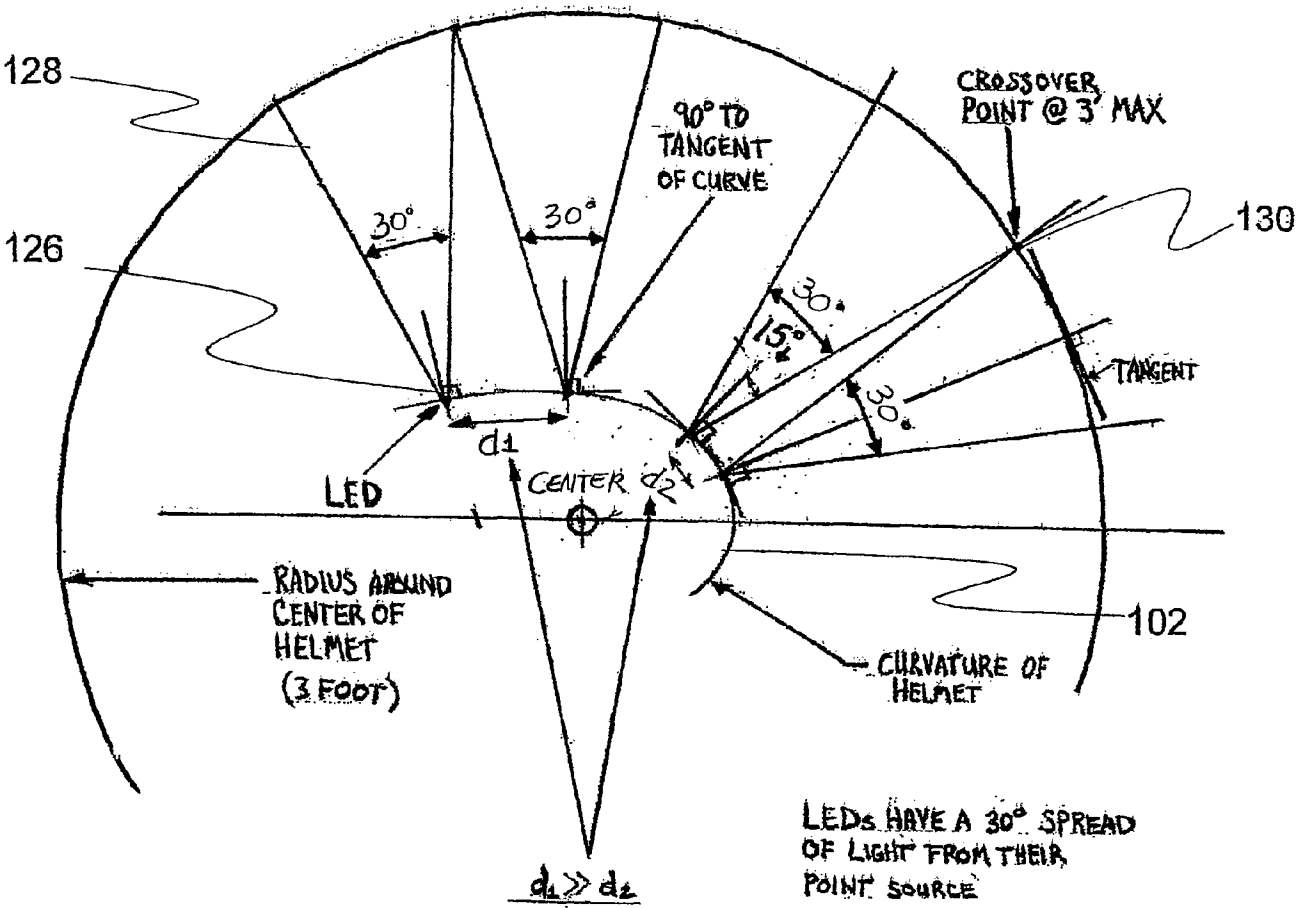
FIG. 5 is an illustration of the viewing angles of LEDs mounted to the helmet according to one embodiment of the present invention.

The term "lamp" is used here to describe any illumination source. In many embodiments, the lamp 108 will most conveniently comprise a light emitting diode ("LED"). Incandescent lamps and solid-state lasers could also be used. In one preferred form, size T1-3/4 LED's are utilized. In another embodiment, 2 millimeter LEDs are used and applied using surface mount technology ("SMT") to keep the thickness low. In order to provide a good level of brightness versus required power, a white LED having a nominal level of brightness 3,000 mcd (millicandelas) with approximately a 20-degree viewing angle is selected. A smaller viewing angle creates brighter LEDs since the light is concentrated within a smaller pattern. The T1-3/4 package is readily usable in the structures described below. Other LEDs could be used in the alternative as well as other forms of lamps. FIG. 5 illustrates one embodiment of an arrangement of LEDs 126 on a helmet structure 102, specifically depicting how the positioning of the LEDs 126 is determined based upon the viewing angle 128 of each LED 126, so that a crossover point 130 is reached no more than 3 feet away from the helmet 100. By implementing a specific density of LEDs 126 to create the crossover point 130 at approximately 3 feet, a viewer will see the brightest point of the LED 126.

The controller 114 is powered by a power source 116. The power source 116 may take a number of forms, for example a battery, hydrogen fuel cell, or other DC power source. The battery may be replaceable or rechargeable, or could be customized to fit the specific needs of the helmet. The power source 116 interfaces with a power terminal (not shown), which may further comprise a battery container in addition to contact electrodes. A power cable 120 connects the power source 116 to the controller 114. A number of conductors are connected to the controller 114 to various lamps 108.

A battery indicator display (not pictured) may be included in the non-impact area 112 of the helmet 100 to provide a ready indication of battery status to a user. In one embodiment, as depicted in the circuit diagram in FIG. 11, the battery indicator display is a single LED that measures the voltage from the battery and provides a color-coded response depending on the voltage measured. For a higher voltage 132, the LED lights up green. For a medium voltage 134, the LED lights up yellow, and for a low voltage 136, the LED lights up red. Finally, at an extremely low level of voltage, the LED flashes red 138 to gain the attention of the user to change the battery or charge the battery, depending on the type of battery implemented. One example of illuminated lamp color versus remaining battery life is: green, 100%-60%; yellow, 60%-20%: red, 21%-10%; flashing red 15%-0%; and off, the lamps 108 are turned off or the batteries are dead. A nominal battery life may be determined by a manufacturer of the helmet 100, and the user may be provided with a table correlating lamp color with an estimate of remaining battery life in terms of time. Other numbers of lamps and other thresholds may be provided and one may chose to provide tactile feedback in the form a small vibrating motor similar to what's used in cell phones to provide feedback that the battery is low.

The battery can be a replaceable battery such as two AA size batteries, or a rechargeable battery that is built into the helmet structure. One advantage of using replaceable batteries is that if a user notices the batteries are low and is not in a location where charging the batteries is possible, the batteries can simply be replaced. In a typical arrangement of LEDs such as the one depicted in FIG. 2, two AA batteries would provide about 20 hours of use.

Figure 6:
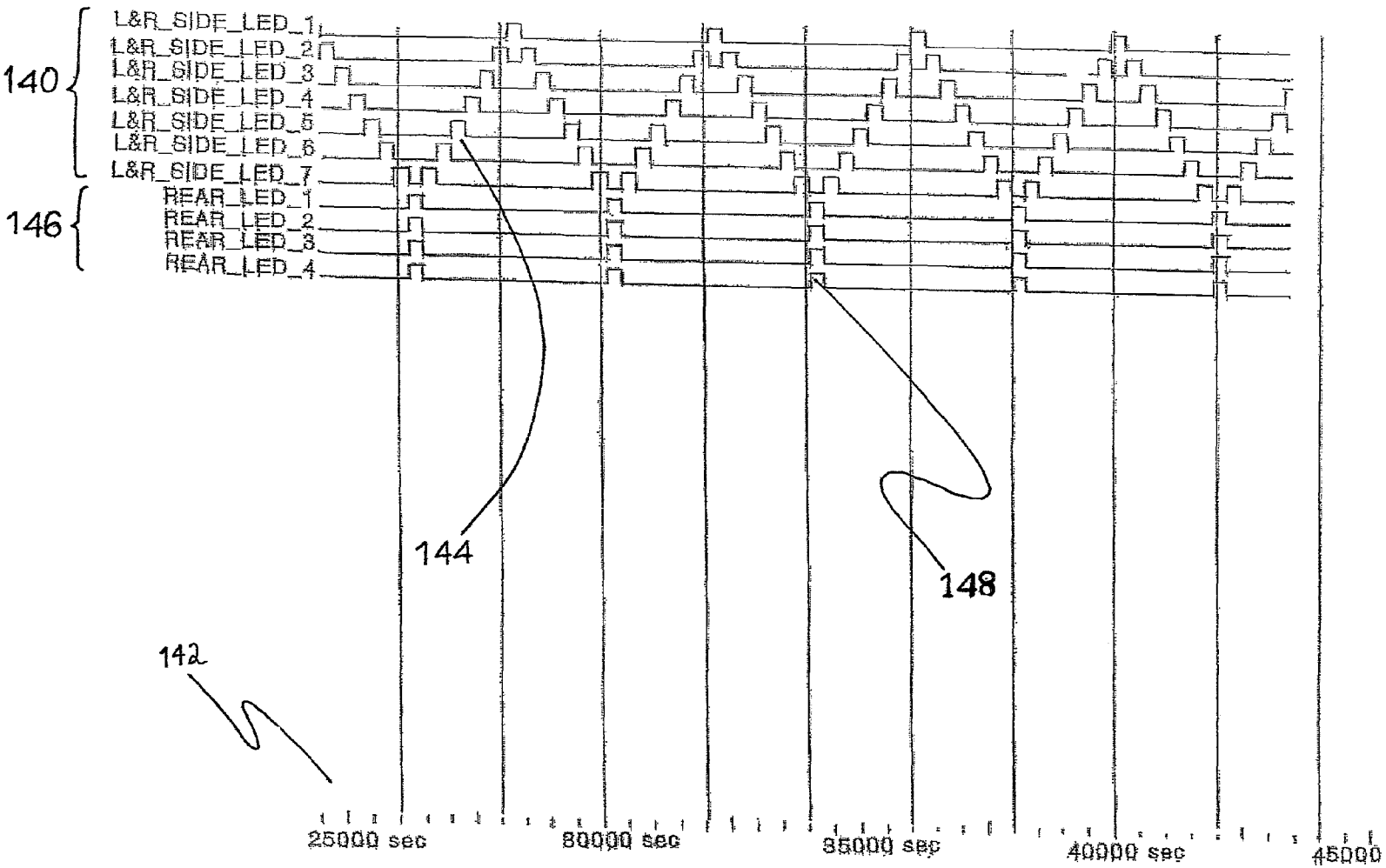
FIG. 6 is a one example of a flash pattern illustrating the timed sequence of illumination of a plurality of LEDs mounted to the helmet.

To conserve power and battery life, the lamps 108 can be programmed to illuminate in sequence instead of simultaneously, using PWM if necessary to even dim the lights down, thereby reducing the total power needed at any one point in time to illuminate the lamps 108. Preferably, the controller 114 is programmed to have lamps, or pairs of lamps, for example, be energized in a sequence. When the lamps 108 are energized, they are intermittently energized to cause them to flash. A flashing pattern within LED array banks is advantageous since flashing an LED uses significantly less battery power than continuous illumination. In one embodiment, the flash period and repetition rate of LED illumination are programmed to provide for a tenfold reduction in power compared to continuous illumination. Since LEDs are energized in sequence, the illusion of a moving point of illumination is created. Motion of the illumination point enhances perception of viewers, rendering a user more highly visible to drivers in the user's vicinity. Alternating the on/off state of a currently selected LED further enhances visibility. FIG. 6 illustrates a flash pattern of a timed sequence of illumination of a plurality of LEDs mounted to the helmet. FIG. 6 is a diagram of one set of illumination patterns that is an example of illumination programs that may be programmed. Many variations are possible. In the illustration of FIG. 6, illumination pulses are of equal duration. This is not essential in FIG. 6, the abscissa is time and the ordinate for each row is voltage applied to a lamp denoted by the label for each row on an arbitrary scale. Each positive-going square wave represents illumination of the respective lamp. Five successive, equal time intervals are illustrated. Lamps are selectively energized by the controller 114. A first set of LEDs 140 mounted on the left and right side of a helmet, for example, fire 144 in consecutive sequence from front to back as time 142 passes. At any one time, only one of the first set of LEDs 140 is firing. In a second set of LEDs 146, such as a large block of 4 LEDs on the rear portion of the helmet, all 4 LEDs fire simultaneously 148, but only when none of the first set of LEDs are firing. At the beginning of each time period, all four second set of LEDs 146 are illuminated at the same time. Then the first set of LEDs 140 are illuminated in succession. This will provide a continually revolving illumination position in the display and periodic flashing of all lamps in the second set of LEDs 146. Battery usage is minimized by flashing one lamp at a time.

Timed patterns may be used. Alternatively, the lamp flashing patterns may be used as right and left turn signals. Many other patterns could be selected. In one embodiment, the flashing patterns can be timed according to known studies on light patterns that capture the attention of the human eye, such as the Blondel-Rey equation (A. Blondel and J. Rey, Sur la perception des lumieres breves a la limite de leur portee, Journal de Physique, Vol. 1, p. 530 (1911).

The electrical system further comprises a controller 114 to which connections are made from the lamps and other components of the illuminated helmet. In one embodiment, the controller 114 is a complex programmable logic device ("CPLD"), which can be programmed to operate to the lamps 108 and coordinate other functions, such as the sensor and battery level indicator. Other types of integrated circuits could be used; for example, a field programmable gate array (FPGA), a micro-controller unit, or a circuit of discrete components.

Additionally, a sound unit may be provided to signal changes in the on/off state of the lamps 108. A sound will enable a user to sense a change of state when the helmet 100 is on a user's head and the lamps 108 are not visible to the user. In one embodiment the sound unit is a piezoelectric speaker that requires minimal space and power to achieve a desired sound effect. Additionally, the sound unit could be replaced with a small vibration device to indicate the state of the lamps 108. The sound unit or vibration device can also be activated to provide the user with additional information, such as when the batteries are low. The circuit diagram of FIG. 14, discussed below, further depicts the implementation of a sound unit or vibration device into the helmet circuitry.

A translucent cover panel (not shown) may be placed over the lamps 108 for protection from the elements or to provide a color filter. Different colors may be used for different purposes. For high visibility, the cover panel could be yellow. For law enforcement applications, the cover panel could have a color corresponding to that of flashing lights used by peace officers. For example, the cover panel would be red for use in New York or blue for use in California.

Figure 7:
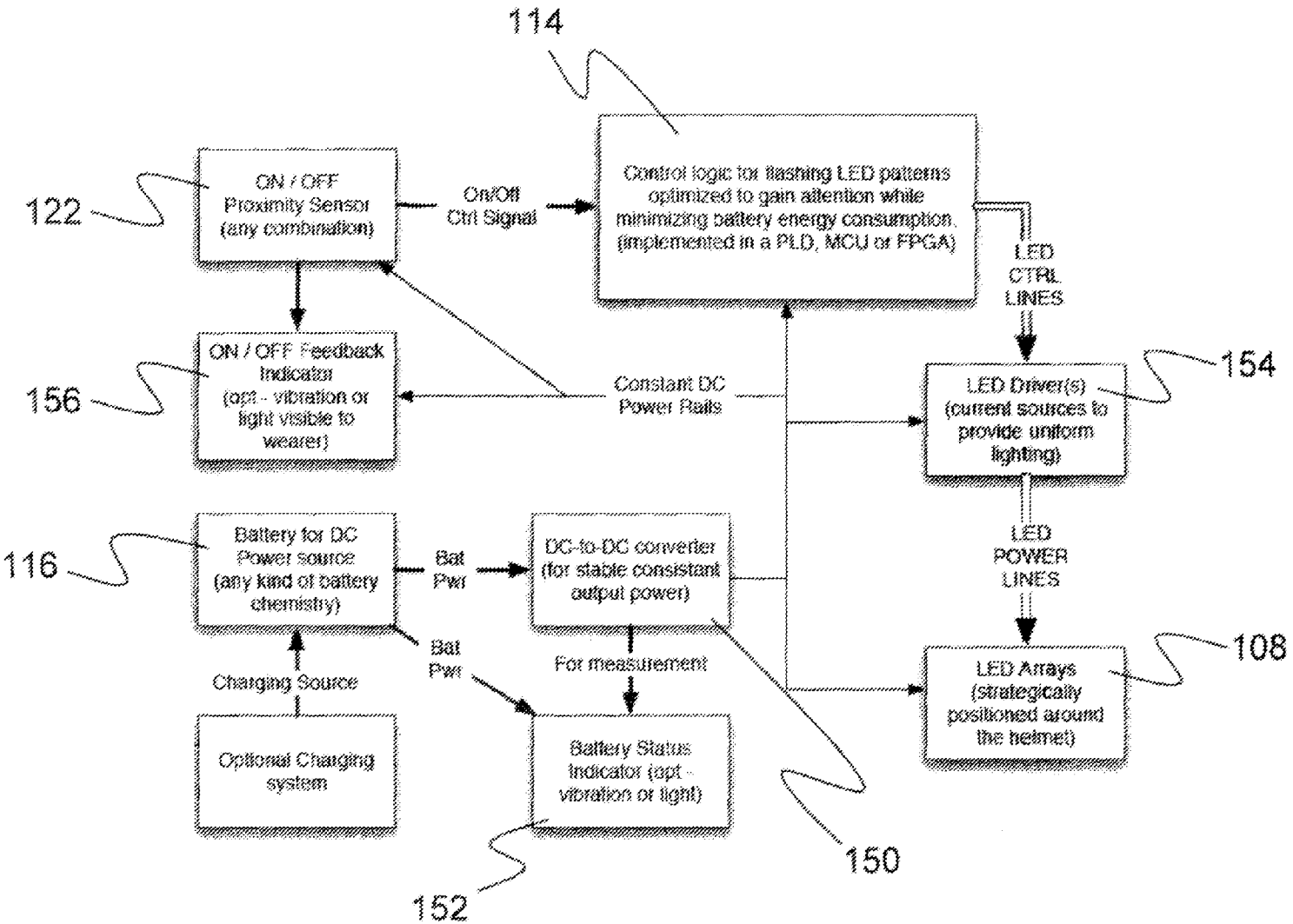
FIG. 7 is a block diagram of one embodiment of the present invention, depicting the logic sequence of components in the helmet when the lamps are activated.

FIG. 7 is a block diagram of the circuitry included in the helmet 100. The controller 114 is preferably connected with a DC-to-DC power converter 150 and a battery status indicator 152. The DC-to-DC power converter 150 receives an input from the power source 116 and provides a constant output voltage. It is desirable to provide a constant voltage output for reliable operation of active circuit components. Also, it is desirable to keep the light output from the lamps 108 constant. Intensity of illumination is proportional to current through an LED. Providing a constant voltage eliminates the need to provide LED driver circuits 154 to maintain the constant current. In one embodiment, the DC-DC power regulator 150 utilizes a buck-boost topology to allow for a varying input voltage from 2.0V to 3.3V, while supplying a constant output voltage of 3.3V.

In this embodiment, a battery status indicator 152 monitors an input voltage level supplied by the power source 116. When input voltage falls below a predetermined threshold, e.g., 2.0V, the battery status indicator 152 provides an output to the DC-to-DC power regulator 150 and the controller 114 to disable operation. The output of the DC-DC power regulator 150 consequently goes to zero. This operation keeps the power regulator 150 from attempting to regulate when the battery level is insufficient to supply an output that can be converted to the constant voltage output level.

The controller 114, as described above is preferably a CPLD. The controller 114 may be programmed to produce preselected light patterns once the lamps 108 are activated. The lighting patterns may be modified by reprogramming the controller 114, and rewiring or adjustment of controls is not necessary.

The proximity sensor 122 is connected with a feedback indicator 156 in one embodiment. As described above, a separate lamp, sound or vibration device can be used to indicate to a user when the lamps 108 of the helmet are illuminated.

Figure 8:
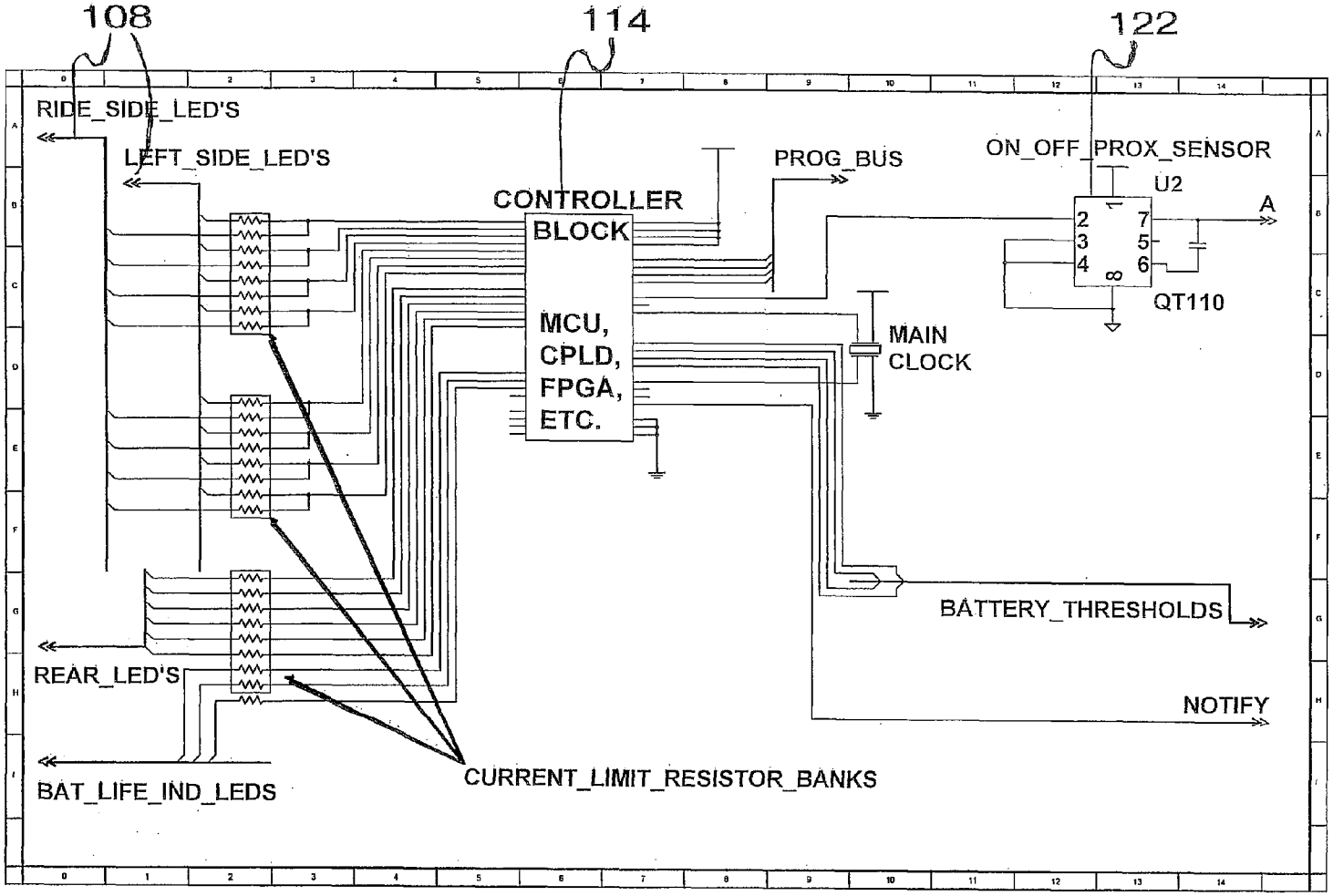
FIG. 8 is a circuit diagram of one embodiment of the illuminated helmet, depicting the electrical connections between the lamps, controller, proximity sensor, and power source.

FIG. 8 is a detailed circuit diagram depicting the electrical connections between the components of the illuminated helmet. The controller 114 is the hub that controls the timing and pattern of signals sent to the numerous lamps 108. The sensor 122 connects directly with the controller to indicate to the controller 114 when the lamps 108 should be illuminated.

Figure 9:
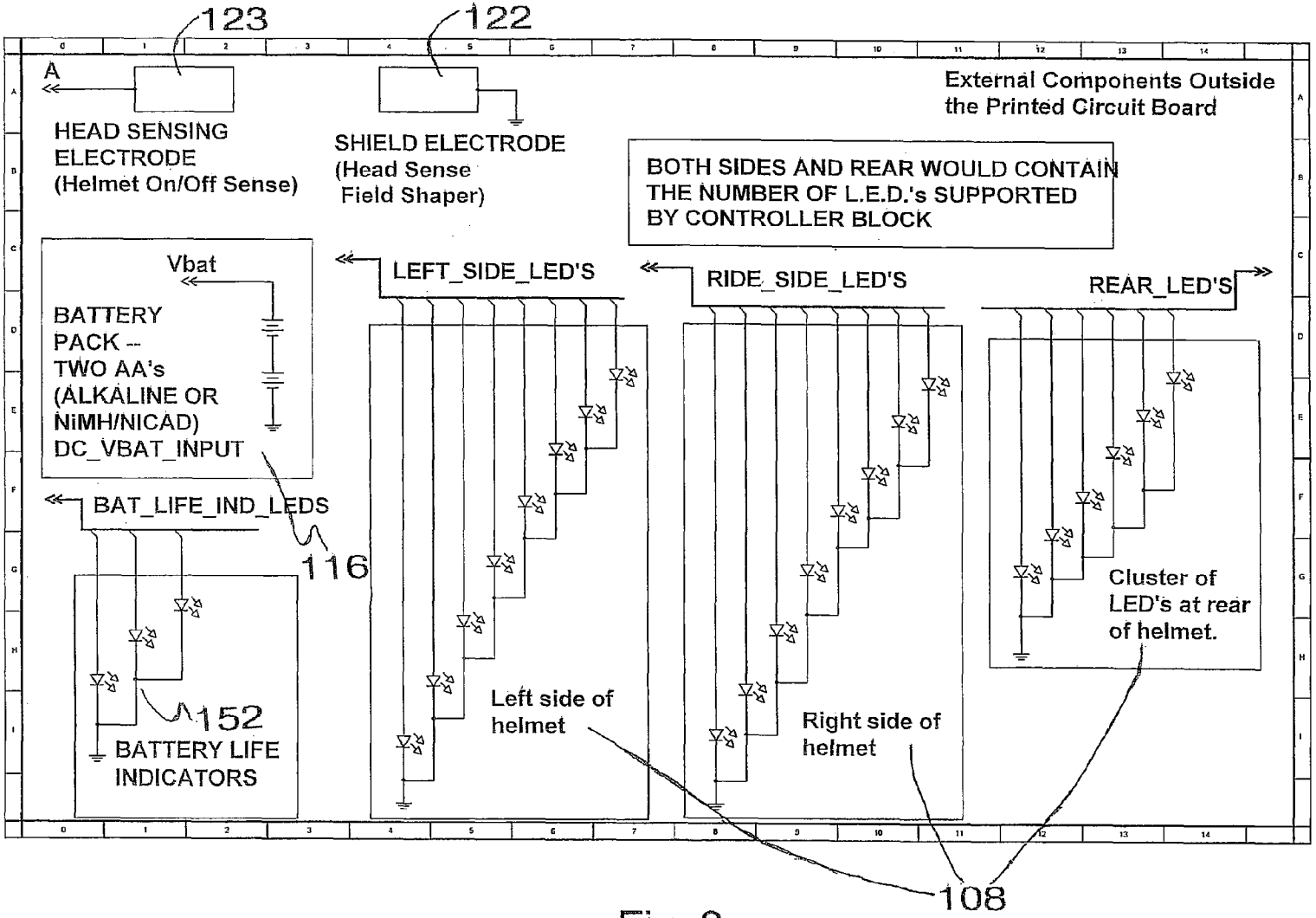
FIG. 9 is a circuit diagram of the components of the illuminated helmet that are not mounted directly on a flexible circuit board but are directly connected with the circuit board.

FIG. 9 is a circuit diagram depicting the components of the illuminated helmet that are not mounted directly on the flexible circuit board, such as the lamps 108, the sensor 122, the battery 116, and the battery status indicator 152.

Figure 10:
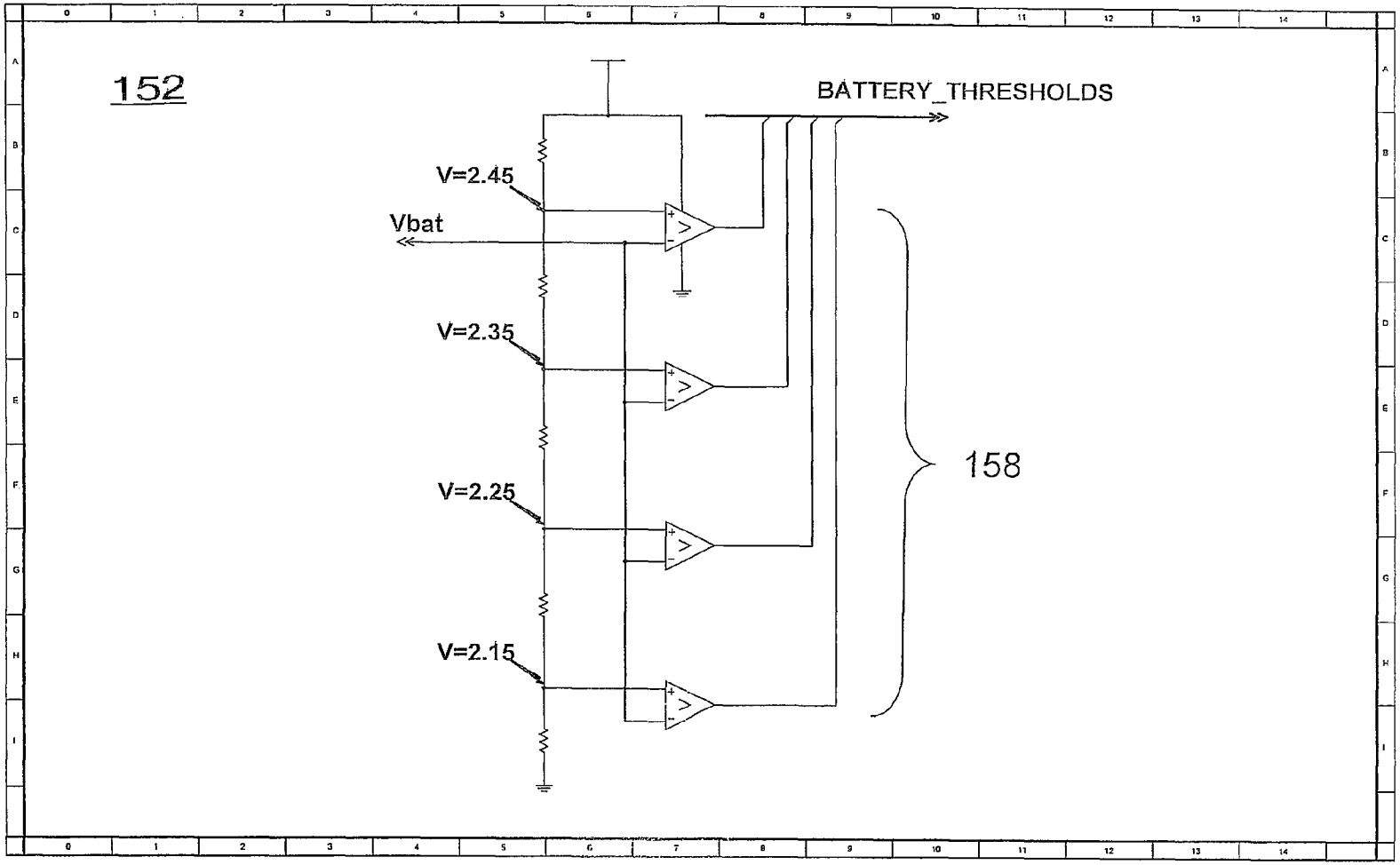
FIG. 10 is a circuit diagram of a battery life indicator according to one aspect of the present invention, where the voltage measured is translated into an color-coded estimate of the amount of time before the battery is depleted of power.

FIG. 10 is a detailed circuit diagram of the battery status indicator 152, depicting the multi-colored outputs 158 for indicating the remaining life of the battery.

Figure 11:
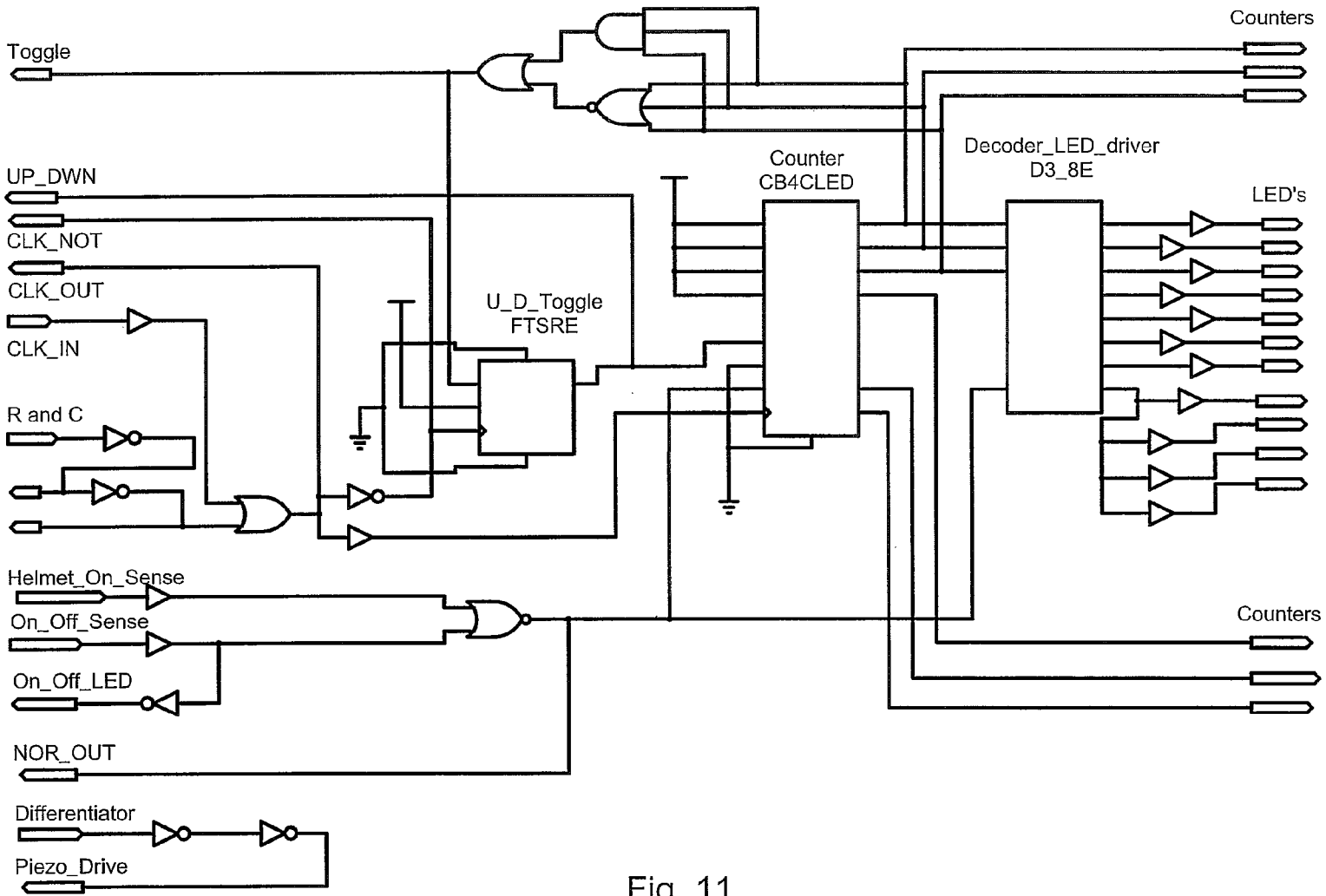
FIG. 11 is a logic diagram according to one aspect of the present invention, depicting the actions taken by the controller and components to determine when the lamps on the helmet should be activated or deactivated.

FIG. 11 is a logic diagram depicting the logic pathways of the circuit diagram depending upon inputs and outputs from the controller and other connected components.

Figure 12:
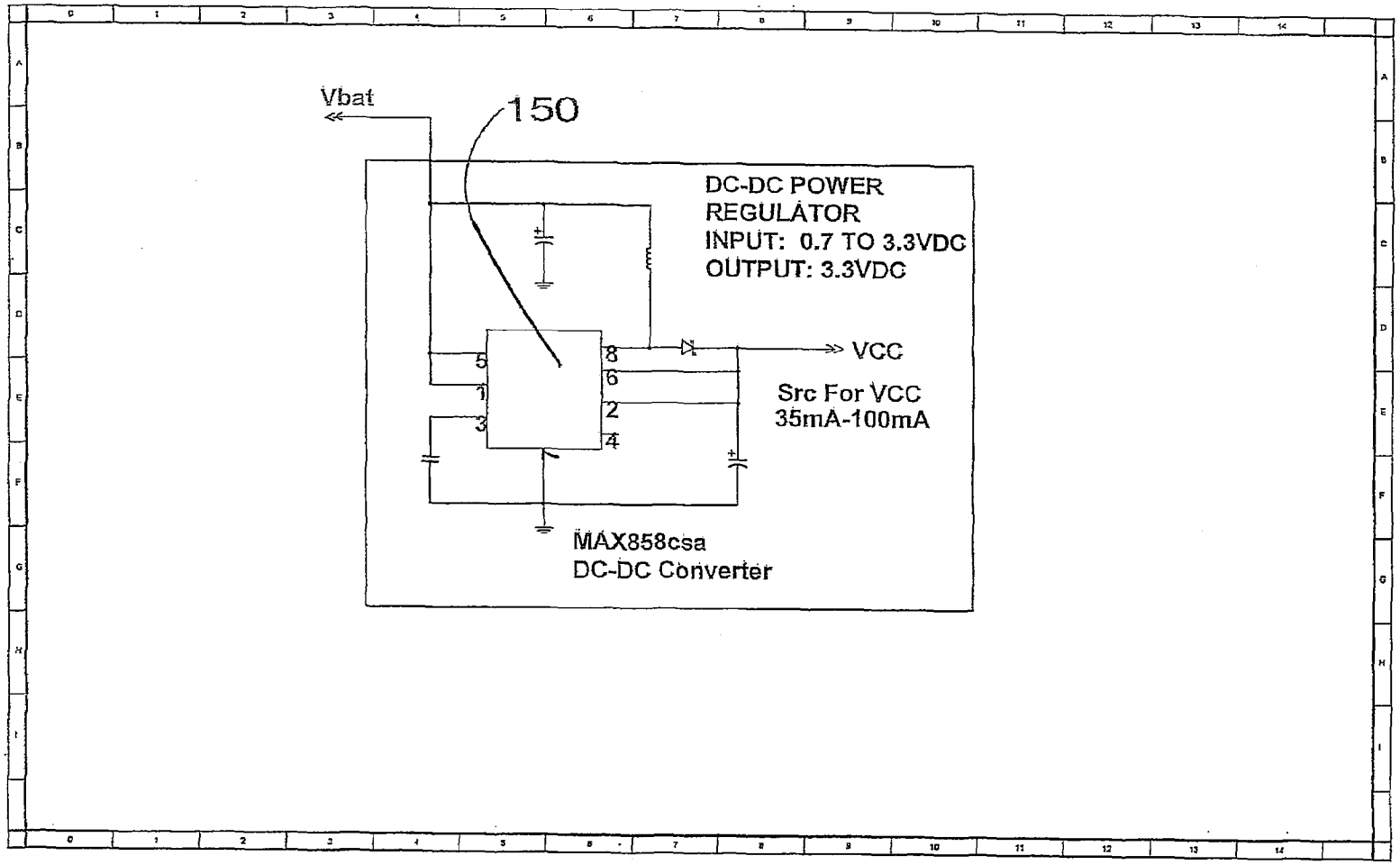
FIG. 12 is a circuit diagram of a power regulator used to supply constant power from the power source to the controller.

FIG. 12 is a circuit diagram of the DC-to-DC power regulator 150 discussed above with regard to FIG. 7. The power regulator 150 provides a consistent flow of power to the lamps 108.

Figure 13:
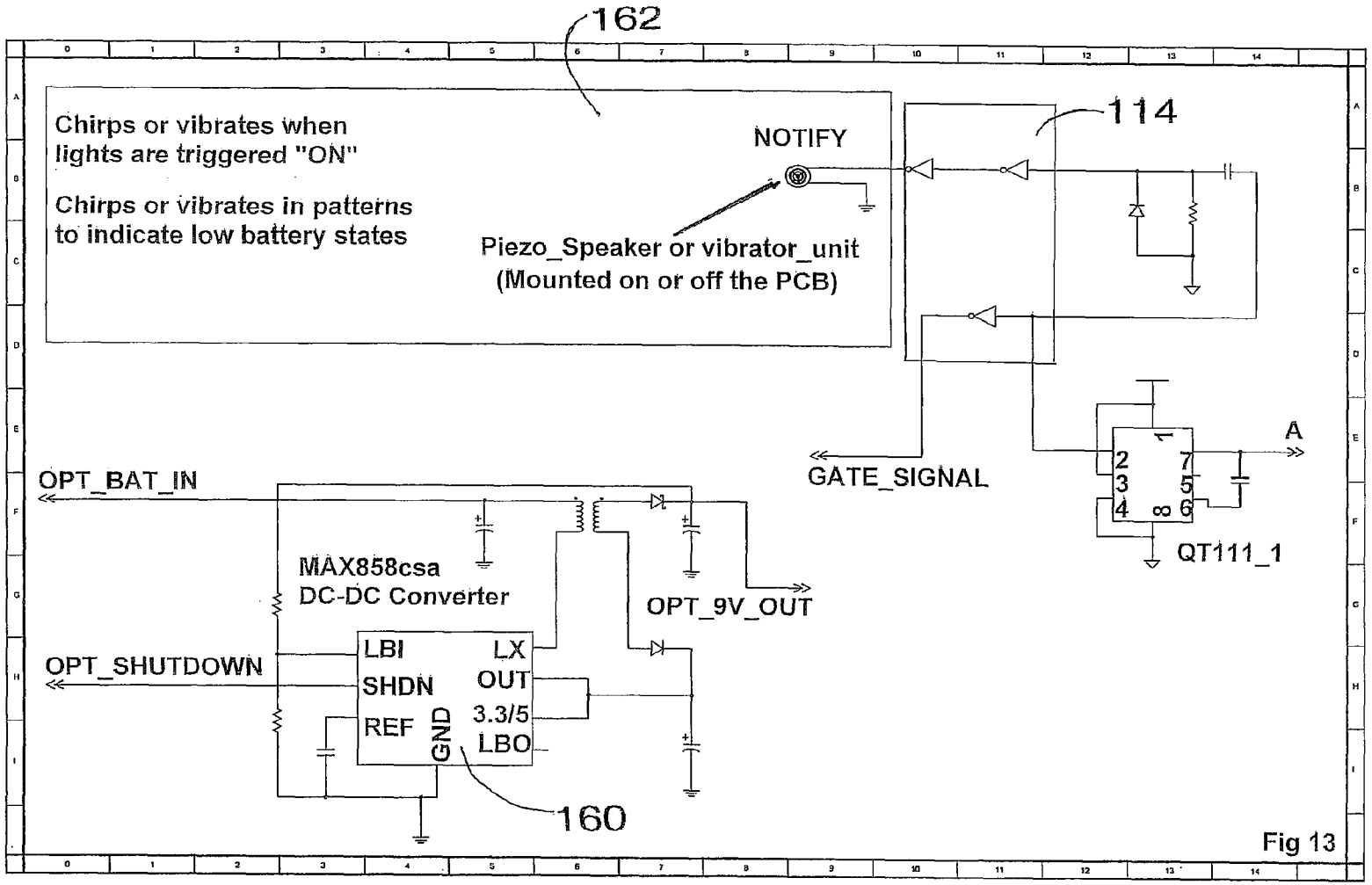
FIG. 13 is a circuit diagram according to a further aspect of the invention, further depicting alternate designs for the circuitry and components of the helmet.

FIG. 13 is a circuit diagram of an alternate DC-to-DC power regulator 160 that can be used for higher wattage LEDs in an alternate embodiment. Additionally, FIG. 13 depicts the circuit connection used for a piezoelectric speaker 162 to use as a feedback indicator, discussed above with regard to FIG. 7. The speaker 162 is connected with the controller 114.

To manufacture an illuminated helmet according to one aspect of the present invention, an in-mold process is disclosed. Unlike the traditional helmet manufacturing process of simply taping the outer shell to the inner core, the in-mold process provides for inserting a pre-molded shell into a helmet mold and then filling the mold with hot, high pressure foam. Once it cools, the foam is taken apart and the outer shell and inner core are now one piece. The shell now looks and feels like it is a solid piece because the foam welds itself to the shell. Now that the shell is attached to the foam, it makes the entire helmet stronger and very sturdy. By laminating and bonding them together, it makes it possible to support many recesses and apertures, and gives the helmet a contour to closely matches the shape of a user's head.

To specifically manufacture an illuminated helmet of the present invention, a process is used to attach the electrical components to the outer shell before the foam inner core is filled in. The components, such as the sensor, power source, controller, and lamps are all affixed to the outer shell. Once the foam is filled in to the outer shell and cooled, the components are a fixed part of the helmet and no external wires or connections between the components are visible.

Embodiments of the present invention provide for an effective and efficient lighting system integrated in a helmet. The present subject matter being thus described, it will be apparent that the same may be modified or varied in many ways. Such modifications and variations are not to be regarded as a departure from the spirit and scope of the present subject matter.

What is claimed is:

1. An illuminated helmet comprising:

a helmet structure with an outer shell and an inner core, wherein the helmet structure is further divided into an impact area on a top half of the helmet structure and a non-impact area on a bottom half of the helmet structure;

at least one recess in the helmet structure;

a plurality of lamps positioned in the recess of the helmet structure;

a controller connected with the plurality of lamps to operate the lamps;

a proximity sensor connected with the controller to activate the controller and lamps upon detection of a user's head an indicator connected with the controller to signal changes in on/off state of the lamps to a user when the helmet is on the user's head; and a power source connected with the controller to provide power to the controller, sensor and lamps, wherein the controller, proximity sensor and power source are located on the non-impact area of the helmet structure.

2. The illuminated helmet of claim 1, wherein the outer shell is a thin layer of plastic, and wherein the inner core is compressible, impact-absorbing foam.

3. The illuminated helmet of claim 1, wherein the recess in the helmet structure is an aperture between the outer shell and the inner core.

4. The illuminated helmet of claim 1, wherein the lamps are positioned on the non-impact area of the helmet.

5. The illuminated helmet of claim 1, wherein the controller is printed on a flexible circuit board.

6. The illuminated helmet of claim 1, wherein the controller is a complex programmable logic device.

7. The illuminated helmet of claim 1, wherein the proximity sensor is an electrode that detects a change in capacitance when a user puts on or removes the helmet, and wherein the proximity sensor sends an appropriate output signal to the controller when the change in capacitance is detected.

8. The illuminated helmet of claim 1, wherein the controller flashes the lamps sequentially.

9. The illuminated helmet of claim 1, wherein the controller flashes the lamps in a sequence designed to gain the attention of a human eye.

10. The illuminated helmet of claim 1, wherein the indicator is a piezoelectric speaker or a vibration device.

11. The illuminated helmet of claim 1, further comprising a transparent protecting layer covering the lamps.

12. The illuminated helmet of claim 11, wherein the transparent protecting layer is clear plastic.

13. The illuminated helmet of claim 1, wherein the power source is a battery.

14. The illuminated helmet of claim 13, wherein the battery further comprises a battery level indicator to provide an indication of the remaining battery life.

15. The illuminated helmet of claim 1, wherein the lamps are light-emitting diodes ("LEDs").

16. The illuminated helmet of claim 15, wherein the LEDs are arranged in groups within the recesses such that the groups of LEDs project light from the helmet in substantially all directions.

17. The illuminated helmet of claim 15, wherein the groups of LEDs are mounted upon a flexible base.

* * * * *